US008015740B2

(12) United States Patent
Jamison et al.

(10) Patent No.: US 8,015,740 B2
(45) Date of Patent: Sep. 13, 2011

(54) FIREARM CONSTRUCTION EMPLOYING THREE POINT BEARING

(75) Inventors: John R. Jamison, Springfield, OR (US); Brian K. Clark, Dexter, OR (US)

(73) Assignee: John R. Jamison, Springfield, OR (US)

( * ) Notice: Subject to any disclaimer, the term of this patent is extended or adjusted under 35 U.S.C. 154(b) by 213 days.

(21) Appl. No.: 12/386,785

(22) Filed: Apr. 22, 2009

(65) Prior Publication Data

US 2011/0185618 A1 Aug. 4, 2011

(51) Int. Cl.
*F41A 3/00* (2006.01)

(52) U.S. Cl. ..... 42/69.02; 42/69.01; 42/2; 42/14; 89/132

(58) Field of Classification Search ..... 42/2, 14–16, 42/69.01, 69.02; 89/132
See application file for complete search history.

(56) References Cited

U.S. PATENT DOCUMENTS

| | | | | |
|---|---|---|---|---|
| 36,014 | A | 7/1862 | Meissner | |
| 1,201,944 | A | 10/1916 | Dodds | |
| 1,469,126 | A | 9/1923 | Thomas | |
| 1,828,287 | A | 10/1931 | MacBean | |
| 2,295,139 | A * | 9/1942 | Topanelian, Jr. | 384/222 |
| 2,324,775 | A | 7/1943 | Hentschel | |
| 2,867,931 | A | 1/1959 | Schreiber | |
| 3,206,885 | A | 9/1965 | Dye | |
| 3,763,855 | A | 10/1973 | McAtee | |
| 3,830,003 | A | 8/1974 | Clerke | |
| 4,312,146 | A | 1/1982 | Koon, Jr. | |
| 4,385,464 | A | 5/1983 | Casull | |
| 4,473,964 | A | 10/1984 | Straub et al. | |
| 5,061,137 | A | 10/1991 | Gourd | |
| 5,339,789 | A * | 8/1994 | Heitz | 124/56 |
| 5,797,234 | A | 8/1998 | Theodorou | |
| 6,637,142 | B1 | 10/2003 | Reynolds | |
| 6,955,513 | B2 | 10/2005 | Niku | |
| 7,625,395 | B2 | 12/2009 | Muckter | |
| 2004/0243129 | A1 | 12/2004 | Moumene et al. | |
| 2010/0083551 | A1 * | 4/2010 | Jamison | 42/75.01 |
| 2010/0319232 | A1 * | 12/2010 | Jamison | 42/75.03 |

* cited by examiner

*Primary Examiner* — Bret Hayes
*Assistant Examiner* — Michael D David
(74) *Attorney, Agent, or Firm* — Chernoff, Vilhauer, McClung & Stenzel

(57) ABSTRACT

A construction for a firearm comprises an action, including a barrel, and a stock. The action is seated to the stock on a three-point bearing system comprising three bearings arranged in a triangular array. This provides for firm seating for the action and results in a more accurate firearm.

24 Claims, 5 Drawing Sheets

FIREARM CONSTRUCTION EMPLOYING THREE POINT BEARING

CROSS-REFERENCE TO RELATED APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

1. Field of the Invention

Conventional rifles employ a construction that includes an action coupled to a barrel and the combination is fitted to a stock. The action and barrel are usually metal parts whereas the stock is usually made of wood, plastic or other synthetic material. When firing the rifle, the user grips the stock, and when the firearm is fired, recoil is transmitted from the barreled action to the stock. Screws that are used to secure the action to stock extend perpendicularly to the direction of recoil forces. These joining members in combination with an imperfect bedding surface (i.e., imperfect mating of barreled action and stock) can cause the action to tilt, cock or be placed in a bind with respect to the stock and this affects the accuracy of the firearm. The fit of the stock and action also affects vibration. For example, most actions include a recoil lug, which is a downwardly extending flange that rests within a notch in the stock. The above-mentioned screws hold these pieces together. Connections between the action and the stock may result in cocking or misalignment because the joining surfaces do not always mate correctly when using conventional screws and a recoil lug. The stock/action interface may be inherently unstable if mating surfaces are uneven or if there are gaps, which can result in misalignment. Alignment is critical because the user always aims the firearm in the same manner, but if the action changes position relative to the stock during firing, prior zeroing of the rifle is rendered ineffective.

2. Description of Related Art Including Information Disclosed Under 37 CFR 1.97 and 1.98

In the past, it has been proposed that metal pieces could be used in the stock to connect to the action and the barrel. Such a construction is shown in Dye (U.S. Pat. No. 3,206,885) and in Clerke (U.S. Pat. No. 3,830,003). The rifle constructions shown in these patents partially alleviate the problem but still fail to create a stable interface between the action and the stock.

BRIEF SUMMARY OF THE INVENTION

A construction for a firearm comprises an action, including a barrel, and a stock. The action is seated to the stock on a three-point bearing system comprising three bearings arranged in a triangular array. This provides for firm seating for the action and results in a more accurate firearm.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENTS

Figure 1:
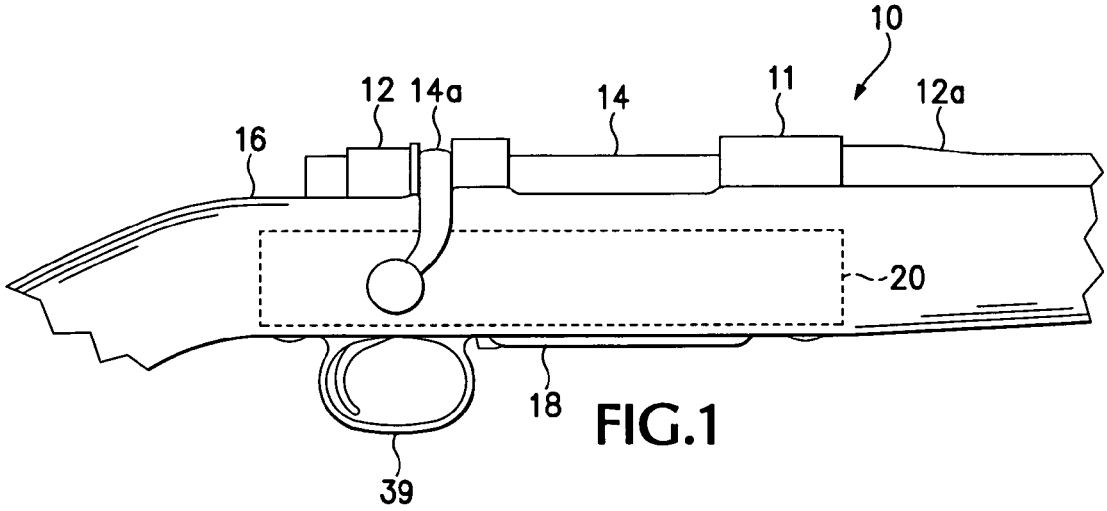
FIG. 1 is a partial side elevation view of a rifle including an action, a stock and a bedding block shown in ghost outline.

In one aspect of the invention, a three-point bearing interface is provided between the action and the stock or a bedding block. The three points are arranged to form a triangle, preferably an isosceles triangle, with two side-by-side bearings being located near the forward portion of the action and a single bearing located on an axial line midway between the two forward bearings and to the rear of the action. This is not an exclusive arrangement as design of the firearm may call for other locations for the bearings. The three bearing points, however, exclusively define the plane of interaction between action and stock and thus provide maximum strength and stability to the action/stock or bedding block interface and helps to prevent recoil forces from setting up inaccuracies due to uncontrolled, unrepeatable or inconsistent vibrations in the action and stock. The three bearings define a plane that extends generally parallel to the bottom surface of the action and the top surface of either the stock or a bedding block. There may be a gap between these surfaces, or the surfaces may touch but with very little compressive force. At least a slight gap is preferable. If desired, the gap may be partially or wholly filled with damping material, such as foam or felt, it being understood that the term "gap" as used herein is a spacing between the action and bedding block or stock surfaces whether or not damping material is interposed therein.

The bearing interface may be implemented in a number of ways. Bearing members may be cast or machined into lower surface portions of the action itself and recesses may be provided in the upper surface portions of the stock. If the stock is made of synthetic material, bearings may be formed in the stock material itself and recesses may be provided in the lower surface portions of the action or the bearing points may have no corresponding recesses. Finally, the bearings may "float", that is, they may be separate elements that fit into recesses in the lower surface portions of the action and upper surface portions of the stock. If desired, the recesses and/or bearing members may be formed in metal inserts that are press fitted into slots in the stock. This is especially desirable when the stock material is much weaker than that used in the action. The recesses may be slightly oversized in at least one dimension relative to the bearing members so that perfect machining is not necessary for a good fit and to allow for some slight expansion and contraction.

The action is joined to the stock so as to apply compression at the three bearing points. Screws may be used which extend through holes in the stock and the action. The screws may secure a trigger guard plate to the bottom of the stock as well. When the screws are tightened providing compressive forces at the bearing points, it will be appreciated that a small gap may remain between bottom surface portions of the action and upper surface portions of the stock. In other words the action and stock are joined at the bearing points and may not be pressed together along their entire upper and lower surface portions respectively. This gap allows the bearings to be the exclusive interface between the action and stock so that the two pieces are held in position relative to one another at the three specified points. The gap also permits the use of damping material, such as a foam, which may be interposed in the gap to aid in damping vibration. Other materials, such as felt or rubber, could also be used. The use of such materials is optional, however, and may be omitted.

The bearings themselves may take several forms including the preferred spherical form, but cylinders, cones, pyramid shapes, and cubic or solid rectangles may work as well.

In another aspect of the invention, a bedding block may replace the interior of the stock so the action is never joined directly to the stock but to the bedding block.

Referring to FIG. 1, a rifle construction 10 includes an action 12 having a barrel 12*a* and a receiver 11. The particular action 12 employed is a bolt action and, as such, includes a bolt 14 and a bolt handle 14*a*. A stock 16 supports the action 12. The rifle construction includes a trigger guard 39 and a floor plate 18. A bedding block 20 is shown in dashed outline. The floor plate 18, the action 12 and the bedding block 20 are all coupled together and surrounded by the stock 16 as will be explained below.

Figure 7:
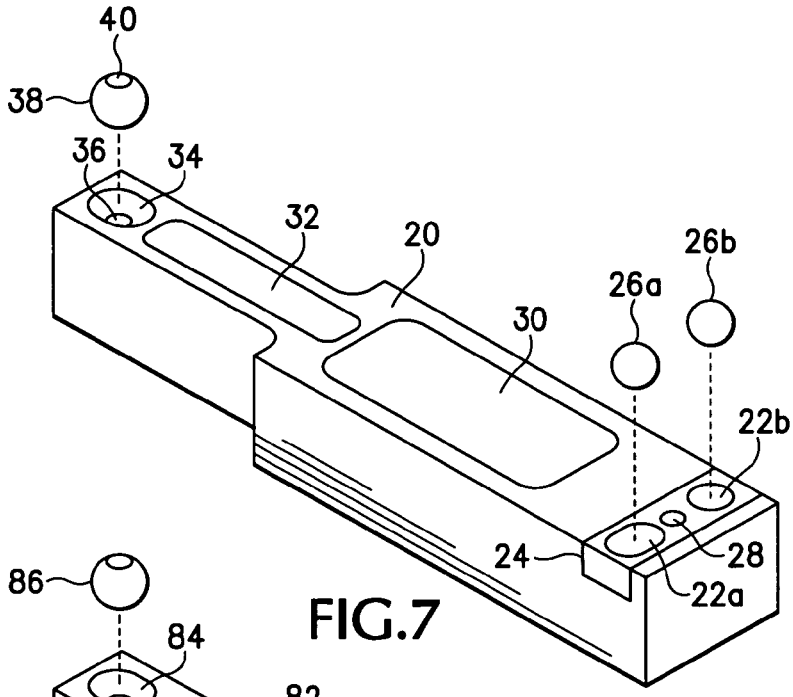
FIG. 7 is a perspective view of a bedding block of the type used in FIGS. 1-5.

Reference is now made to FIG. 7, which illustrates the construction of the bedding block 20 shown in the embodiment of FIG. 1. The bedding block 20 is an insert made of a hard material, such as steel or Delrin®, that may be fastened inside the stock by glue. At its forward end, the bedding block 20 includes a pair of recesses 22*a* and 22*b*. The recesses 22*a* and 22*b* reside within a steel insert 24. The bedding block 20 may be made of a lighter material, such as aluminum, and the steel insert 24 provides the necessary tensile strength to support the parts and functions that will be described herein. The recesses 22*a* and 22*b* support a pair of side-by-side bearing members 26*a* and 26*b*. These bearing members are preferably substantially spherical in shape, although other shapes for bearing members could also be employed such as cones, pyramids, cylinders or rectangular bearing members. In such cases, the mating recesses would be similarly shaped. A hole 28 extends through the bedding block between the recesses 22*a* and 22*b*. The bedding block 20 includes an opening 30 through which a cartridge magazine (not shown) may extend. Alternatively, the magazine may be integral with the bedding block. A second opening 32 to the rear of the magazine opening 30 permits a trigger mechanism to extend through the block. Located behind the trigger opening 32 is a single recess 34, which also includes a hole 36 that extends through the bedding block 20. A single bearing member 38 rests in the recess 34. Like bearing members 26*a* and 26*b*, the bearing member 38 is preferably substantially spherical. However, unlike bearing members 26*a* and 26*b*, the bearing member 38 includes a central hole 40, which aligns with the hole 36 in the bedding block 20. Collectively the three bearing members are arranged to define the three points of an isosceles triangle.

Figure 2:
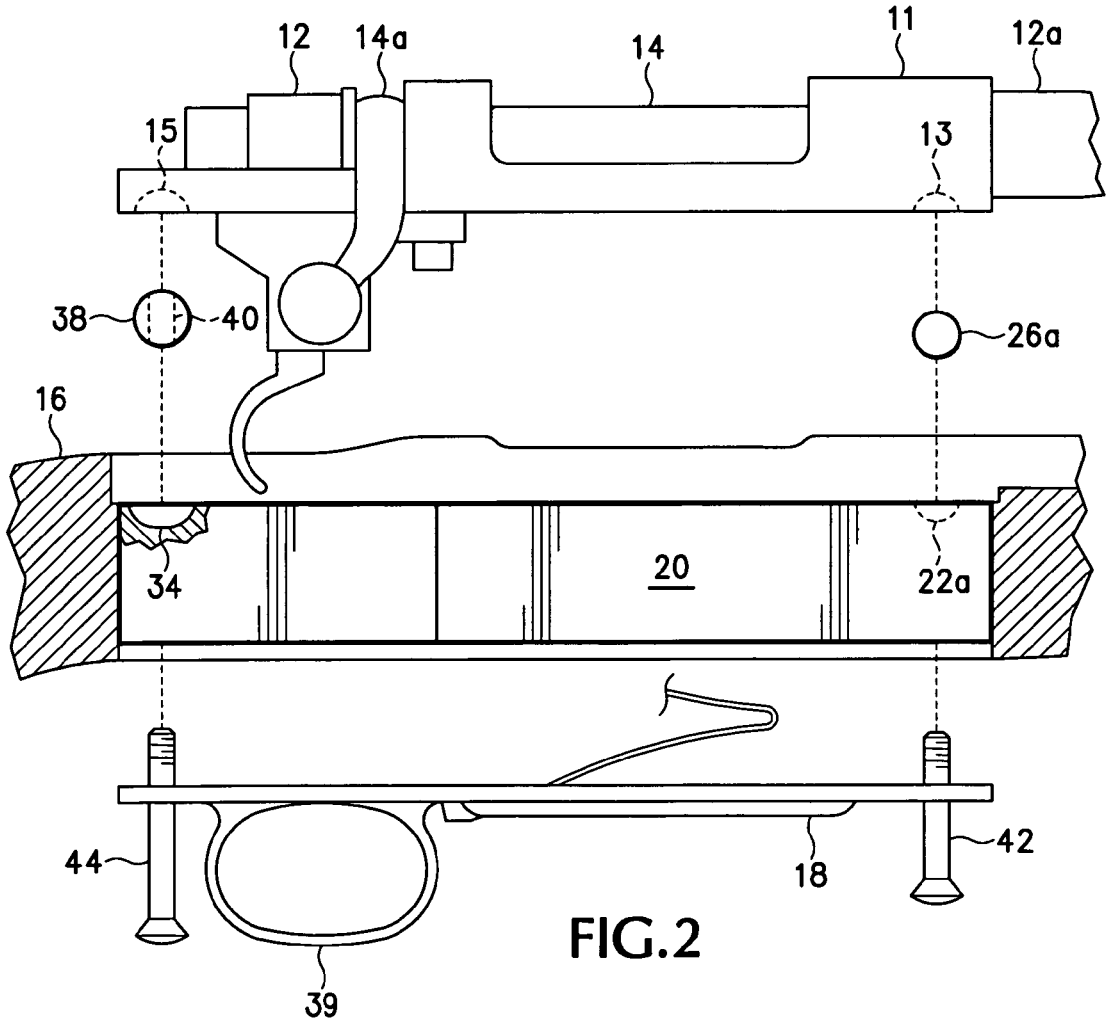
FIG. 2 is an exploded side elevation view of the rifle construction of FIG. 1.

In FIG. 2, the bearing members 26*a* and 38 are free-floating bearings and fit within recesses 34, 22*a* in the bedding block 20 and in recesses 13, 15 in the action 12. It will be appreciated that the bearings 38, 26*a*, 26*b* need not be free-floating but could be formed in the bedding block itself as substantially hemispherical protrusions or, alternatively, be formed in the action in the same manner.

Figure 4:
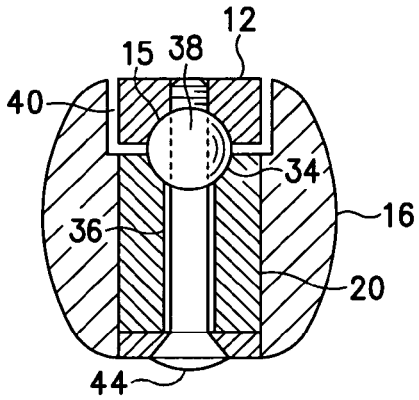
FIG. 4 is a rear cutaway view taken along line 4-4.
Figure 5:
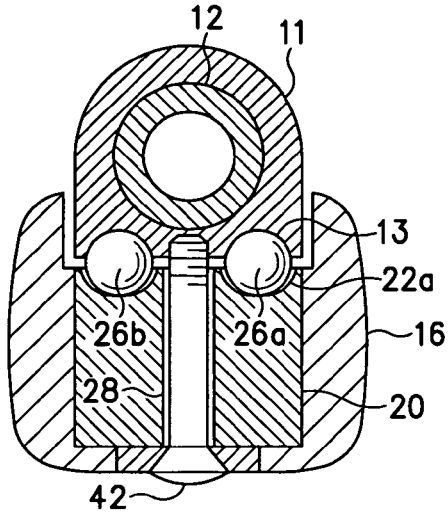
FIG. 5 is a front cutaway view taken along line 5-5.

Referring now to FIG. 2, the floor plate 18 is connected to the receiver 12 by threaded bolts or screws 42 and 44. The screw 42 extends through a hole 36 in the bedding block 20 (shown best in FIG. 5) and threadingly engages the action 12. It should be noted that the hole 36 (see FIG. 5) is oversized slightly with respect to the shaft of the screw 42. To the rear of the trigger guard 39, a screw 44 extends through a hole 28 in the bedding block 20 and threadingly engages the action 14. The screw 44 extends through the bearing member 38, which includes an accommodating hole 40. Like the hole 36 at the forward end of the bedding block, the hole 28 (see FIG. 4) is oversized relative to the shaft of a screw 44. In both instances, this permits some reciprocal movement as will be explained below.

Figure 3:
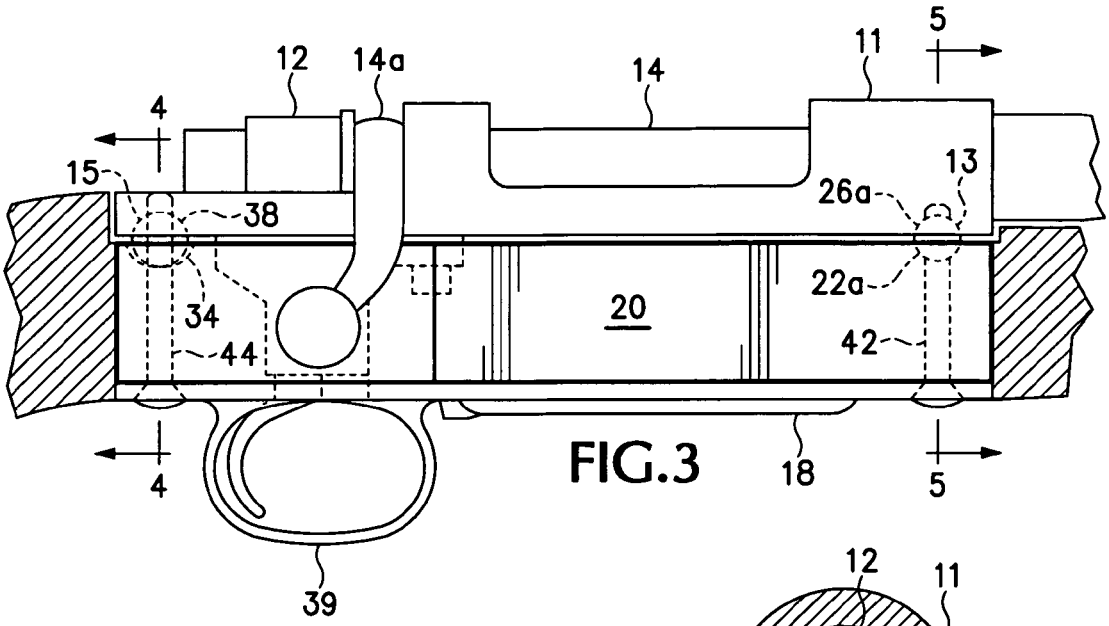
FIG. 3 is a side elevation view of the rifle construction of FIG. 1 showing selected internal parts in ghost outline.

Referring to FIG. 3, it should be noted that the recess 34 in the bedding block is slightly elongated along the axis of the rifle with respect to the shape of the bearing 38. Recess 22*a* is also slightly elongated perpendicular to the axis of the rifle. This allows nearly perfect alignment during assembly without perfect machining. Thus with the oversized holes and slightly elongated bearing recesses, the action may be joined to the bedding block such that the bearings will seat properly.

Screw-type fasteners are preferred for joining the bedding block to the action. The screws may be stock steel screws or may be made so as to allow them to flex. For example, a screw having a wound wire shank can flex slightly. In either case, the holes should be made slightly oversized with respect to the diameters of the screws so that there may be some slight movement within the holes without causing the bolt or screw to bind up or cock under the recoil forces generated when firing, or misalignment when the firearm is assembled.

Figure 6:
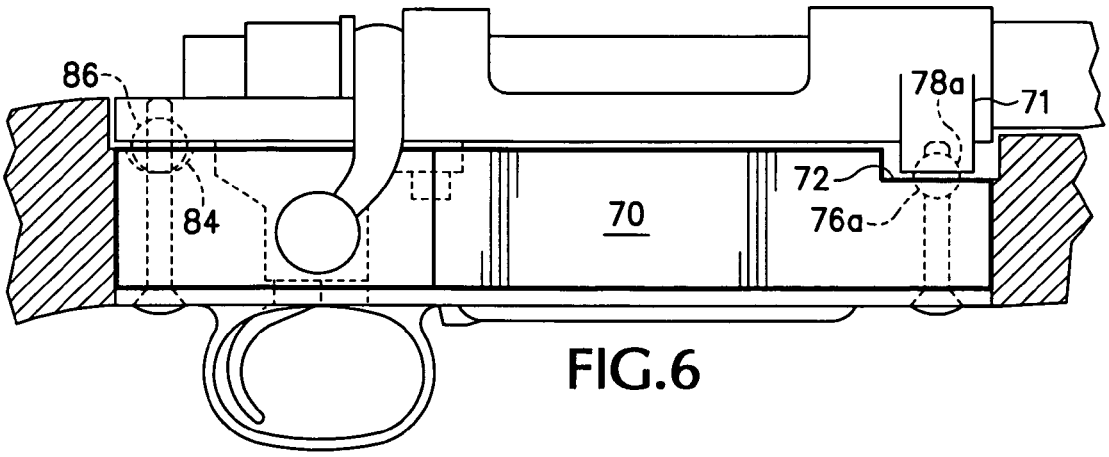
FIG. 6 is a side elevation partially-cutaway view of an embodiment in which the action includes a recoil lug.
Figure 8:
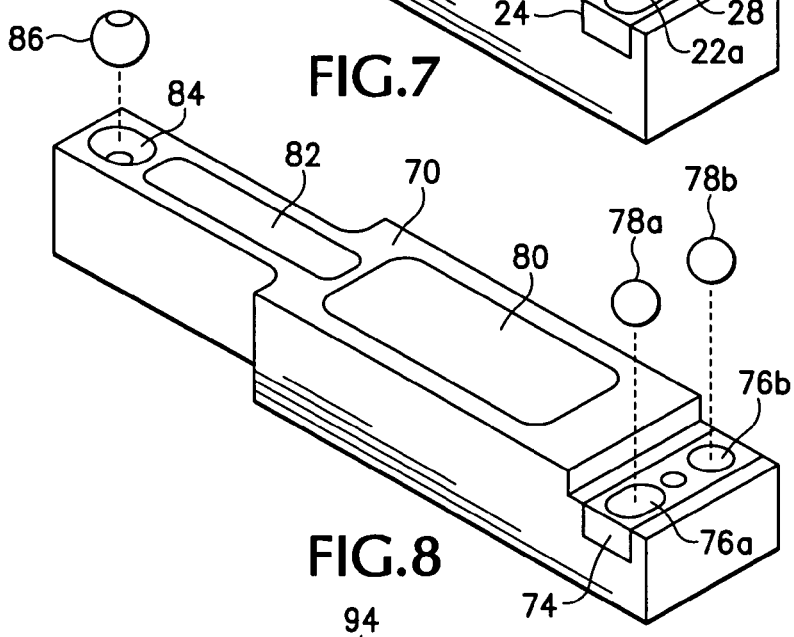
FIG. 8 is a perspective view of a bedding block of the type used in FIG. 6.

Referring now to FIG. 8, a bedding block 70 is shown that is in all respects similar to the bedding block of FIG. 7 with the exception that this embodiment may be used with a receiver which has a recoil lug 71 (see FIG. 6). The front of the bedding block 70 has a cutaway portion 72, which houses a steel insert 74. As was the case with the embodiment of FIG. 7, the insert 74 includes recesses 76*a* and 76*b* into which spherical or ball bearings 78*a* and 78*b* are seated. The bedding block 70 has an opening 80, which may function as a magazine, and a rear opening 82 for accommodating the trigger mechanism. A rear recess 84 houses the third ball bearing 86 of the three-point bearing system. Recesses 76*a* and 84 are slightly elongated.

Figure 9:
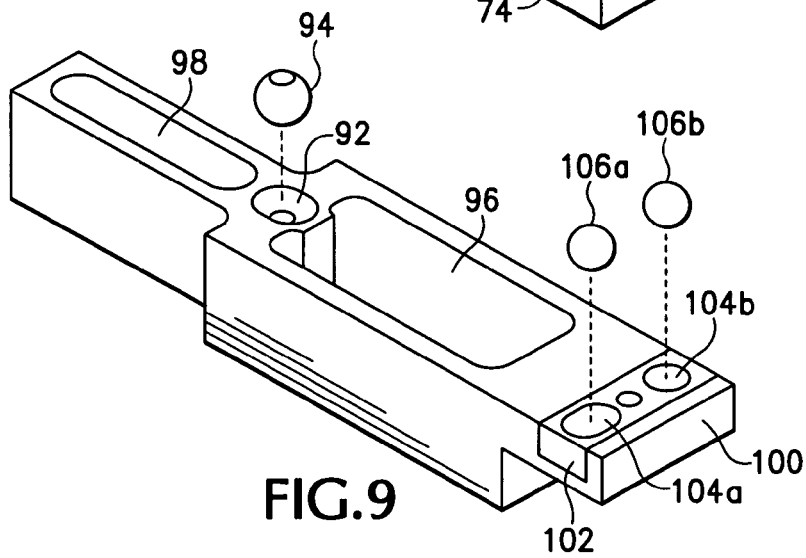
FIG. 9 is another embodiment of a bedding block for use in rifles having a slightly different construction.

Yet a different construction for the bedding block is shown in FIG. 9. In this construction, the rear bearing recess 92 and associated bearing 94 are situated between the magazine 96 and the trigger mechanism opening 98. To accommodate a different stock construction, the front underside portion of the bedding block is cut away, leaving a forward flange 100, which accommodates the steel insert 102. As in FIGS. 7 and 8, the insert 102 houses side-by-side recesses 104*a* and 104*b*, which receive spherical ball bearings 106*a* and 106*b* respectively. Recesses 104*a* and 92 are slightly elongated.

FIGS. 8 and 9 show that the construction of the rifle illustrated herein can be altered to accommodate different styles of firearms having differing internal dimensions and configurations. The construction described above eliminates inaccuracies inherent in the traditional way of coupling the action to the stock. The typical screw-type coupling between the action and the stock is avoided with the bedding block insert and bearings as described above. In this construction, there is no large flat mating surface between stock and receiver to cause problems in coupling the receiver to the stock.

The preferred embodiment provides the feature of a three-point bearing system, using three steel ball bearings as the contact points. The rear screw 44 goes directly through the center of the rear steel ball 38 and the forward two balls 26*a*, 26*b* are located directly to either side of the forward screw 42.

The bedding block goes completely through to the bottom of the stock so that the screws tighten the floor plate 18 directly and solidly against the aluminum block 20, drawing the barreled action 12 directly onto the ball bearings, and not into wood or synthetic stock material. Thus, there is no stock compression when the screws are tightened. The entire bedding system is metal on metal at three discrete points, virtually making one unit with the non-stress three-point system.

The stock is thus relegated to the role of a mere handle glued onto the bedding block and surrounding the important parts (important for accuracy) of the bedding block. With the metal system, there is no expansion or contraction, warping or twisting from temperature and humidity changes. The differential expansion/contraction in the aluminum/steel setup between the bedding block and steel inserts is so small over these short distances as to be insignificant over the ambient temperature range.

The screws 42 and 44 should permit perfect action seating and also allow for any tiny shift of fore-and-aft/lateral distance change. Also, the magazine box is incorporated directly into the bedding block. Therefore, there is no need for a separate magazine in the stock.

The system eliminates the necessity for detailed and sometimes complex stock cutouts and it eliminates the requirement for a recoil lug. The major features can be cast into an aluminum block with minimal machining. The steel inserts such as inserts 24, 74 and 102 may be pressed into the aluminum block with recesses formed to accept the steel ball bearings.

The system also eliminates the traditional weak points in the stock along either side of a typical magazine box. These relatively long and thin areas in the stock separate fore and aft bedding points on traditional stocks, which is a major problem regarding accuracy. The aluminum bedding block 20 and glue add strength in this important region of the stock 16. The aluminum bedding block 20 also adds strength and protection around the complex and sometimes-delicate trigger mechanism 13. All of this is hidden within the stock. The aesthetics of a fine wood stock can be realized along with the practical advantages of a synthetic stock. There are, in fact, more advantages in the aluminum bedding block than in a simple synthetic stock. The bedding block can also be used in a synthetic stock, if desired.

The bedding block may be cast and machined to dimensions that will fit the interior of the stock. The exterior dimensions of the bedding block are not critical and will be different, depending on the individual rifle into which it is fitted. The important points to consider when fitting it to a specific rifle are the location of the action screws specific to the rifle being used, and the fitting of the block to the floor plate to match the existing lines of a rifle stock. Again, these will vary, depending on the rifle being used. In addition, any cast-in, machined in, or separate recoil lug can be eliminated with this system.

Figure 10:
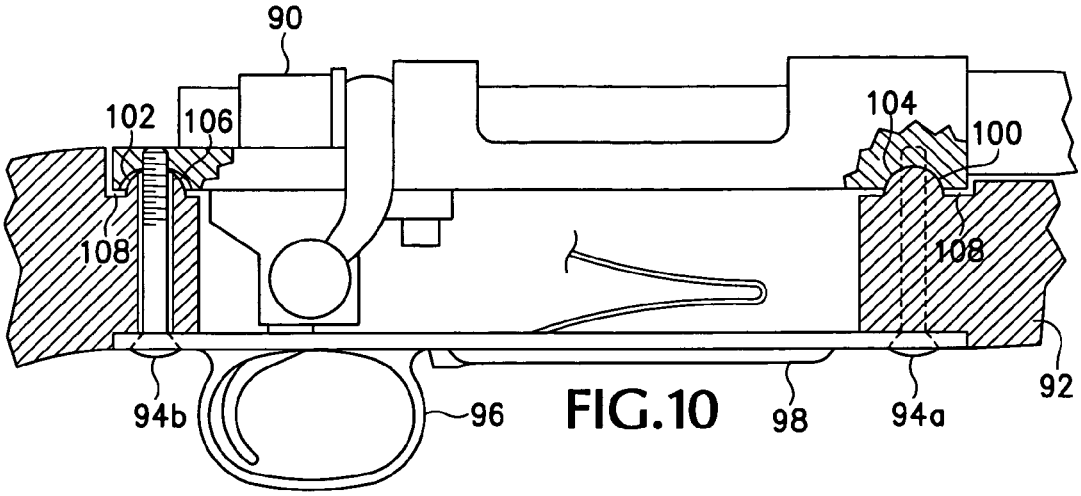
FIG. 10 is a partial side cutaway view of a firearm showing an alternate embodiment in which bearings are formed in the stock material.

Advantages can be gained, however, from the use of bearing members arranged in a three-point array even if a metallic bedding block is not used. For example, a substantial improvement over the existing interface between receiver and a stock made of wood or synthetic material can be realized if the stock is made of a strong enough material or contains a metallic insert having bearing members that interface with correspondingly shaped recesses. Referring to FIG. 10, an action 90 is coupled to a stock 92 with screws 94*a* and 94*b*. In this case, the stock material includes a pair of formed bearing members situated forward of the trigger guard 96 and the magazine 98. Only one forward bearing member 100 is shown in FIG. 10, but the second bearing is located on the opposite side of the stock. The screw 94*b* extends through a rear bearing member 102. The bearing members 100, 102 and the second bearing member (which is not shown in FIG. 10 but which is part of side-by-side pair similar to what is shown in FIGS. 7-9) form an isosceles triangle. The action 90 includes recesses 104, 106 (only one of the recesses 104 is shown in FIG. 10). When the bearings are mated with the recesses and the screws are tightened, the action is coupled to the stock leaving a small gap 108. Thus, the action 90 and the stock 92 bear directly against each other only at the three-point bearing interface so that this interface takes the entire load of compression generated by the tightening of the screws. As with the embodiments employing the bedding block, the holes for the connecting screws are slightly oversized in diameter so recoil forces are not passed through a screw by setting up skewed force vectors between the action and the stock.

Figure 11:
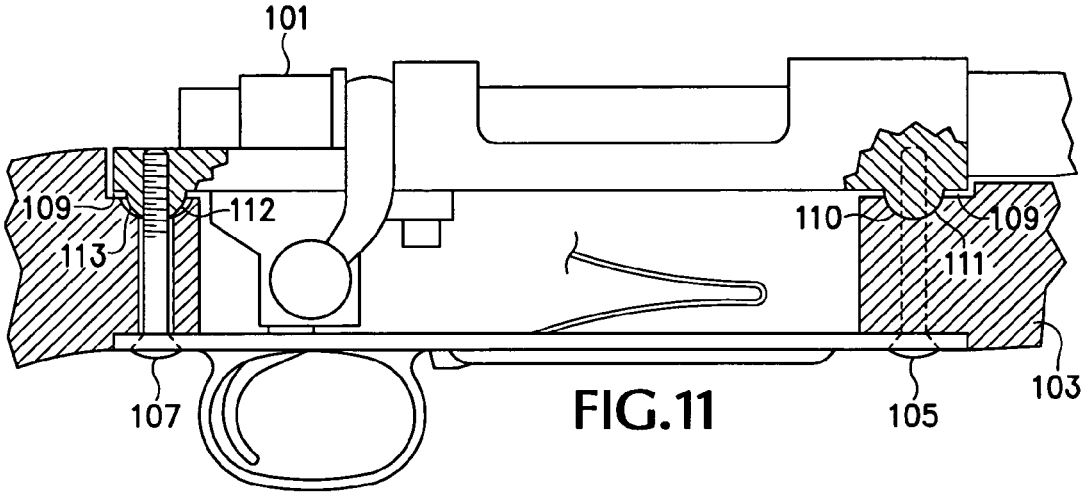
FIG. 11 is a partial side cutaway view of a firearm showing an alternate embodiment in which bearings are formed in the action.

A similar structure is shown in FIG. 11, except in FIG. 11 the bearing members 110 (opposite bearing member not shown) and 112 are formed in the action and recesses 111 and 113 are formed in the stock. When the action 101 is fastened down to the stock 103 by the screws 105, 107 a small gap 109 separates the remainder of the action 101 from the stock 103.

Figure 12:
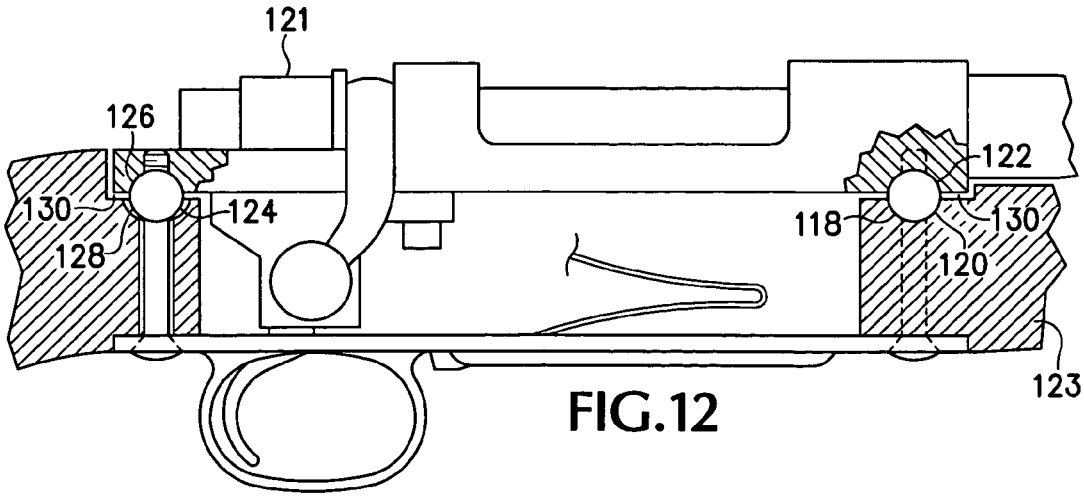
FIG. 12 is a partial side cutaway view of a firearm showing an alternate embodiment in which the bearings are free floating.

A similar design is shown if FIG. 12, but in FIG. 12, instead of forming the bearings in the action or the stock material, the bearings are free floating. Thus, bearing 118 is one of a pair of forward bearings; the other bearing is not shown in FIG. 12. Bearing 118 sits in recesses 120, 122 formed in the stock and action respectively. Single bearing 124 situated to the rear of the magazine and the trigger sits in recesses 126 and 128 in the action and stock respectively. As was the case with the embodiments of FIG. 10 and FIG. 11, a slight gap 130 exists between the action 121 and the stock 123 because the bearings 118 and its twin and bearing 124 take the compressive load imparted by the screws 131 and 133.

Figure 13:
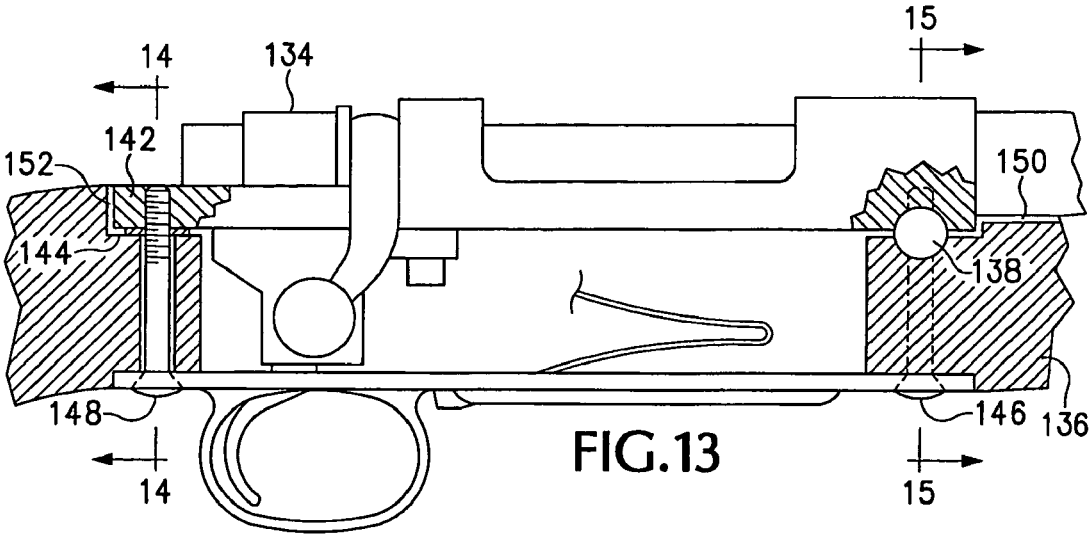
FIG. 13 is a partial side cutaway view of another embodiment showing a firearm having a rounded action.
Figure 14:
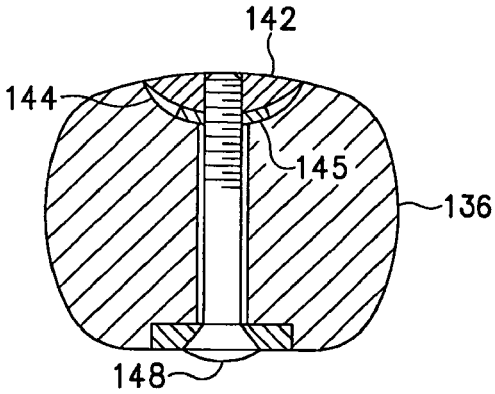
FIG. 14 is a cutaway view taken along line 14-14 of FIG. 13.
Figure 15:
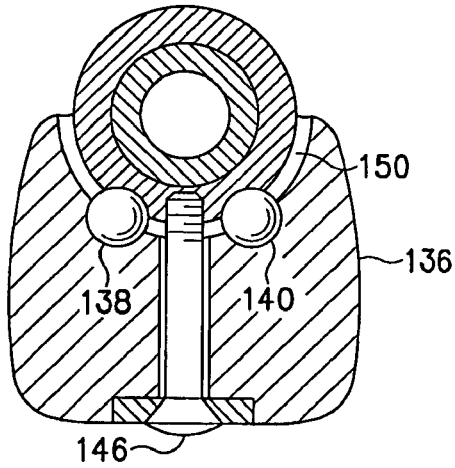
FIG. 15 is a cutaway view taken along line 15-15 of FIG. 13.

Reference is now made to FIGS. 13, 14 and 15, which illustrate an embodiment in which the action has a rounded lower profile. The action 134 fits into the stock 136 on a three-point bearing interface, which includes forward bearings 138 and 140, and a rear downwardly extending rectangular pad 142, which fits within a correspondingly shaped recess 144 in the stock. If desired, a washer 145 may be used with the screw 148. To conform to the curved surface of the stock, the washer 145 may be made of a resilient material such as a fibrous material or foam. Front and rear screws 146 and 148 join the stock to the action while leaving small gaps 150, 152 so that the three bearings 138, 140 and 142 bear the compressive forces.

With all of these designs, some recesses that accept the bearing members are slightly elongated perpendicular to the axis of the barrel while the rear recess may be elongated parallel to the barrel's axis. This is preferred but not required for the proper functioning of the three-point bearing system described herein. Further, depending upon the material of the stock, metallic inserts may or may not be required. For example, in the embodiment of FIG. 11 where the bearings are formed into the action, metallic inserts housing the recesses could be used if the stock is made of wood or similar weaker material. The same is true of FIG. 12 in which free-floating bearings are used.

Although the formed bearings in FIGS. 12 through 17 have been shown mostly as substantially spherical (in the case of the floating bearings) or hemispherical (in the case of bearings formed in the stock and/or action themselves), other shapes including solid rectangles, cylinders, cones, or pyramid shapes could be used if desired.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A firearm construction comprising an action having a lower surface portion and a stock having an interior upper surface portion and comprising a three-point bearing interface between said action and said stock and fasteners for compressively joining said action to said stock at said three-point bearing interface while leaving a gap between said lower surface portion of said action and said interior upper surface portion of said stock.

2. The firearm construction of claim 1 wherein a three-point bearing interface comprises three bearing members formed in said action and three cooperatively situated recesses formed in said stock.

3. The firearm construction of claim 1 wherein a three-point bearing interface comprises three bearing members formed in said stock and three cooperatively situated recesses formed in said receiver.

4. The firearm construction of claim 1 wherein a three-point bearing interface comprises three floating bearing members situated in cooperatively positioned recesses in said stock and said action respectively.

5. The construction of claim 1 or 4 wherein said three-point bearing interface forms an isosceles triangle.

6. A construction for a firearm comprising an action including a barrel, a stock, the stock including an interior metallic bedding block wherein the action is seated to the bedding block on a three-point bearing system comprising three bearing members arranged in a triangular array.

7. The firearm construction of claim 6 further including at least a pair of fastening devices extending through the bedding block and into the action wherein said fastening devices each include an axial shaft having a diameter and said bedding block includes holes accommodating the axial shafts, said holes being oversized relative to said diameter.

8. A construction for a firearm comprising:

a) an action coupled to a barrel, the action including a bottom surface portion having a plurality of recesses;

b) a stock;

c) a bedding block situated in the stock for mating with the action, the bedding block including a plurality of bearing members mating with said recesses in said bottom surface of said action;

d) a plurality of fasteners having shafts extending through holes in said bedding block for securing said action to said bedding block; and wherein said action includes a pair of spaced-apart recesses in a forward end of said bottom surface and a single recess situated rearwardly of said pair of spaced-apart recesses to thereby form a triangular bearing interface between said action and said bedding block.

9. The construction of claim 8 wherein said fasteners are screw-type fasteners that screw into complementary threaded openings in said receiver.

10. The construction of claim 9 wherein said fasteners extend upwardly through a floor plate sandwiching the bedding block between the floor plate and the action.

11. The construction of claim 10 wherein said fasteners each include a shaft and wherein holes in said bedding block are slightly oversized relative to the shafts of the fasteners.

12. The construction of claim 9 wherein one of said fasteners extends through a hole in one of said substantially spherical bearings situated rearwardly of the pair of bearing recesses.

13. A construction for a firearm comprising:

(a) an action coupled to a barrel, the action including a bottom surface portion having a plurality of recesses;

(b) a hollow stock;

(c) a bedding block situated inside the hollow stock for mating with the action and including a triangular bearing construction interacting with the action to form a triangular bearing interface comprising two bearing members located side-by-side near a forward end of said bedding block and a single bearing member centrally located toward a rear end of said bedding block; and (d) a trigger guard plate fastened to said action and sandwiching the bedding block therebetween.

14. The rifle construction of claim 13 wherein the bearing members are substantially spherical bearings.

15. The rifle construction of claim 13 wherein one of said fasteners extends through said single bearing member.

16. The rifle construction of claim 13 wherein said action includes a recoil lug and the forward bearing members mate with recesses in the bottom of said recoil lug.

17. The rifle construction of claim 16 wherein the bearing members are substantially spherical bearings.

18. The rifle construction of claim 17 wherein at least one of the fasteners extends through the single bearing member.

19. The rifle construction of claim 18 wherein the bearing member is a substantially spherical bearing.

20. The rifle construction of claim 13 wherein each fastener includes a shaft that is yieldable in a direction perpendicular to the shaft.

21. A rifle construction comprising:

(a) an action coupled to a barrel;

(b) a trigger guard plate; and (c) a bedding block sandwiched between the action and the trigger guard plate including a triangular bearing interface interacting between a bottom of the action and a top of the bedding block, said interface including three bearing members seated in respective recesses formed in said top of said bedding block and said bottom of said action.

22. The rifle construction of claim 21 further including fasteners extending from said trigger guard plate through holes in said bedding block and into said action, said holes being large enough to allow movement within said holes by said fasteners in response to recoil forces.

23. The rifle construction of claim 21 wherein said bearing members are substantially spherical bearings.

24. The rifle construction of claim 21 wherein said triangular bearing interface includes a pair of side-by-side bearings situated toward a forward end of said bedding block and a single bearing centrally situated toward a back end of said bedding block.

* * * * *